United States Patent [19]

Neumann et al.

[11] Patent Number: 4,693,002

[45] Date of Patent: Sep. 15, 1987

[54] METHOD OF MANUFACTURING CONTACT SPRING PROCEDURE

[75] Inventors: Gerhard Neumann, Waldkraiburg; Hans Ramisch, Mühldorf, both of Fed. Rep. of Germany

[73] Assignee: Otto Dunkel GmbH Fabrik fur Elektrotechnische Gerate, Muhldorf am Inn, Fed. Rep. of Germany

[21] Appl. No.: 913,566

[22] Filed: Sep. 29, 1986

Related U.S. Application Data

[63] Continuation of Ser. No. 718,447, Apr. 1, 1985, abandoned.

[30] Foreign Application Priority Data

Apr. 5, 1984 [DE] Fed. Rep. of Germany ..... 3412875

[51] Int. Cl.[4] ..... H01R 43/04

[52] U.S. Cl. ..... 29/882; 29/874; 439/843

[58] Field of Search ..... 29/874, 876, 882; 339/252 P, 256 R, 256 RT, 256 S, 256 T

[56] References Cited

U.S. PATENT DOCUMENTS 4,087,152 5/1978 Kolm ..... 339/256 R X

FOREIGN PATENT DOCUMENTS 1082957 6/1960 Fed. Rep. of Germany ..... 29/874

1263893 3/1968 Fed. Rep. of Germany ... 339/256 R 340878 10/1959 Switzerland ..... 339/252 P 1203775 9/1970 United Kingdom ..... 339/256 R

*Primary Examiner*—Howard N. Goldberg

*Assistant Examiner*—Carl J. Arbes

*Attorney, Agent, or Firm*—Holman & Stern

[57] ABSTRACT

The method relates to manufacturing contact spring sockets with a plurality of radially inward bowed contact springs clamped at one end in an approximately cylindrical socket body, formed by a thin-walled deformable sleeve. After introduction of the straight contact springs into the socket body from one socket end, they are made fast by deformation of the socket material and their free ends are brought into supporting abutment on an annulus. This is associated with a mandrel for assisting assembly, which passes through it and which is during manufacture introduced co-axially into the socket body and finally withdrawn from it. Subsequently the mandrel together with the annulus is introduced into the socket body. The contact springs are then, by applying axial pressure on their ends, converted into a shape bowed into the interior of the socket until they abut the mandrel. Thereafter, the mandrel is withdrawn from the socket body with relaxation of the permanently deformed contact springs and the annulus is held fast in its position in the socket body by folding over of the socket body edge.

2 Claims, 5 Drawing Figures

METHOD OF MANUFACTURING CONTACT SPRING PROCEDURE

Figure 1:
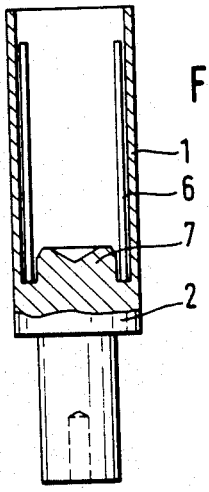
Figure 2:
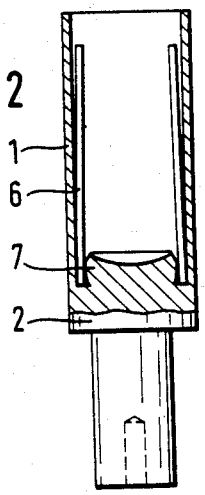

This is a continuation of application Ser. No. 718,447, filed Apr. 1, 1985, now abandoned.

This invention relates to a method of manufacturing contact spring sockets with a plurality of radially inward bowed contact springs clamped at one end in an approximately cylindrical socket body, formed by a thin-walled deformable sleeve, wherein a mandrel is co-axially introduced into the socket body at the pin insertion end, wherein straight contact springs, formed by sections of a contact spring wire, are introduced into the socket body from one socket end, and subsequently when in an aligned state relative to each other in the socket body, are by deformation of the socket material made fast at their front ends to a central annular head at the front end of a line connector which projects into the socket body, and wherein the free ends of the contact springs are brought into supporting abutment on an annulus through which a mandrel passes associated therewith for assisting assembly, which mandrel is during the manufacture introduced co-axially into the socket body and finally withdrawn from it.

A method of this type which belongs to the state of the art, according to which contact spring sockets of particularly small construction can be manufactured, is described in the Patent application No. P33 42 742.9-34 which is not a prior publication. This method uses sleeves with a wall thickness of 0.1 mm, economically prefabricated by drawing, which can easily be deformed from outside. After introduction of the contact springs the sockets are provided with a radially inward projecting annular indentation at each of two spaced apart regions axially offset relative to the annulus and the annular head respectively. These annular radial indentations press on the contact springs and bow them radially inward.

In this manner contact pins of only about 0.6 mm diameter can be provided with sockets with an external diameter of only about 1.5 mm. Thus an extraordinarily large number of contact spring sockets can be arranged next to each other in a very small space, and thereby high quality multicontact connectors can be produced at low cost.

In this method of manufacture the degree of deformation of the socket body determines the size of the annular indentations and thus the bowing of the contact springs, on which in turn the contact force depends.

It has been shown, that deformation of the socket body to form the annular indentations can be omitted, if according to a modified method in accordance with the invention the thin contact springs with a diameter of maximally 0.2 mm after introduction into the socket body, whereby their front ends enter a co-axial annular gap between the socket inner wall and the central head of the line connector which projects into the socket interior, are made fast in a position approximately parallel to the axis by deformation of the head, that subsequently the mandrel together with the annulus is introduced into the socket body, that the contact springs are then by applying axial pressure on their ends converted into a shape bowed into the interior of the socket until they abut the mandrel and that thereafter the mandrel is withdrawn from the socket body with relaxation of the permanently deformed contact springs and the annulus is held fast in its position in the socket body by folding over of the socket body edge.

With this method it is only necessary to determine the depth of penetration of the mandrel carrying the annulus with it in dependence on the desired permanent deformation of the contact springs, which determines the contact forces of the finished contact spring socket, in order to obtain qualitatively uniform sockets.

It has proved particularly suitable for obtaining contact spring sockets guaranteeing sufficient and uniform plugging-in forces, if a mandrel is used which has a diameter which is smaller than the diameter of the contact pins, for which the contact pin socket is intended.

Figure 5:
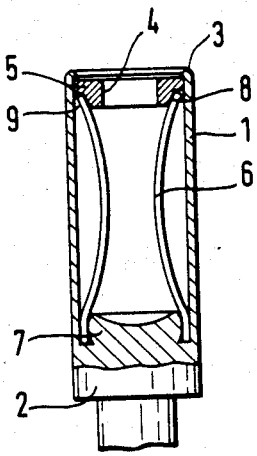

Further details, advantages and features of the invention emerge from the following description and the drawing, to which express reference is made as regards all details not described in the text. There is shown in:

FIGS. 1 to 4 very schematically the method steps of the method according to the invention, and FIG. 5 a contact spring socket made according to the method of the invention.

As can be seen from the drawing, the contact spring socket illustrated in FIG. 5 comprises an approximately cylindrical socket body 1 in the form of a thin-walled deformable sleeve. This socket body 1 forms a constructional unit with line connector 2. At the opposite end the socket body 1 has a flange 3 for securing an annulus 5, which abuts flange 3 and has a central pin insertion opening 4. A plurality of very thin contact springs 6 is arranged around the internal circumference, which springs have a diameter of maximally 0.2 mm. These contact springs 6 are made fast at one end between a disc-shaped central head 7 of line connector 2 which projects into socket body 1 and the end of socket body 1 which rises up from line connector 2. The other ends of springs 6 which face the pin insertion end of socket body 1, abut annulus 5 having a conical outer suface 8 which together with socket body 1 defines an annular gap 9.

The radially inward bowing of the contact springs illustrated in FIG. 1 is achieved by applying axial pressure to the thin contact springs 6, as will subsequently appear from the explanation of manufacture using FIGS. 1 to 4. For this purpose the steps which are used in the method of manufacture according to the invention are schematically illustrated in FIGS. 1 to 4. Firstly the socket body 1 is positioned ready, into which the contact springs 6 are introduced with the aid of delivery apparatus not shown in detail. With their front ends they enter the gap between the disc-shaped central head 7 and the socket wall and take up a position closely adjacent the latter, FIG. 1. In the further step illustrated in FIG. 2 the contact springs are secured in their inserted position by applying axial pressure to central head 7 of the line connector which deforms it.

Figure 3:
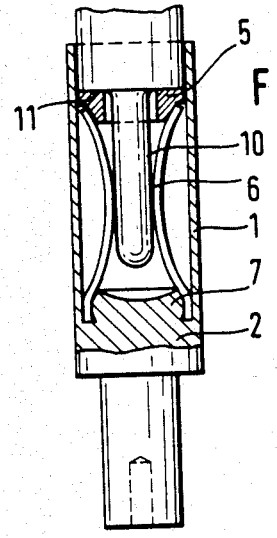
Figure 4:
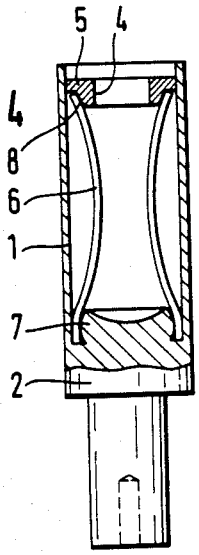

From FIG. 3 it can be seen, that subsequently a mandrel 10 together with annulus 5 are introduced into socket body 1. For this purpose the mandrel 10 used has, extending transversely to the axis of the mandrel, a shoulder 11 on which annulus 5 is supported. Contact springs 6 on whose ends annulus 5 comes into abutment at first oppose further movement of the annulus as well as of the mandrel 10; however because of their small diameter the desired bending and bowing quickly occurs. With this it has turned out, that the latter takes place radially inward so that the contact springs take up the position illustrated in FIG. 3 in which they come into abutment with the mandrel 10. The latters diameter is chosen somewhat smaller than the diameter of the contact pins for which the contact spring socket is intended.

On subsequent release of annulus 5 by removal of mandrel 10 (compare FIG. 4) contact springs 6 relax, although they retain the illustrated permanent deformation, that is the bowing. The smallest mutual distance apart of those bowed contact springs 6 which lie in any one axial plane of the socket is then still less than the internal diameter of the annulus, namely of the pin insertion opening 4. By these means perfect mutual contact is ensured when the annulus in the subsequent final process step is made fast in its position in the socket body by folding over the socket body edge. After this folding over the contact spring socket is finished, and the prescribed functional tests can be carried out.

What is claimed is:

1. A method of manufacturing contact spring sockets, comprising the steps of:

providing a plurality of sections of straight contact springs from said contact spring wire;

providing a socket body having a generally cylindrical sidewall, a first, open end, a bottom, and an interior portion adapted to receive ends of said straight contact springs; including providing a generally disc-shaped central head projecting into said interior portion from said bottom of said socket body disposed generally co-axially within said sidewall body;

inserting said plurality of straight contact springs into said socket such that ends of said straight contact springs are received by said portion of said socket body adapted to receive said ends; said portion being a generally annular space between said central head and said sidewall;

aligning said straight contact springs parallel to one another within said socket body;

fixing said ends to said interior portion between said sidewall and said central head by deforming said central head;

providing a mandrel having an end and an annulus disposed generally concentrically about said end of said mandrel, said end of said mandrel having a diameter sufficiently small to permit entry into said first, open end of said socket body;

inserting said mandrel into said socket body at said first, open end thereof such that a co-axially annular gap exists between an inner wall of said socket body and said end of said mandrel;

moving said mandrel into said socket body until said annulus of said mandrel contracts free ends of said straight contact springs;

continuing movement of said mandrel toward said receiving portion of said socket body until said straight contact springs are deformed inwardly toward said cylindrical projection until a predetermined degree of curvature of said contact springs occurs;

withdrawing said mandrel while said annulus remains in fixed relationship to said socket body, such that said contact springs remain curved;

and deforming a portion of said socket body adjacent said annulus to fixedly retain annulus within said socket body.

2. The method according to claim 1, wherein in said step of providing said mandrel, wherein said cylindrical projection has a diameter which is sufficiently small to enter said socket body without initially contacting said straight springs.

* * * * *